US007114718B2

(12) United States Patent
Grauzer et al.

(10) Patent No.: US 7,114,718 B2
(45) Date of Patent: Oct. 3, 2006

(54) SMART TABLE CARD HAND IDENTIFICATION METHOD AND APPARATUS

(75) Inventors: Atilla Grauzer, Las Vegas, NV (US); Oliver M. Schubert, Las Vegas, NV (US); James V. Kelly, Las Vegas, NV (US); James B. Stasson, Eden Prairie, MN (US); Paul K. Scheper, Eden Prairie, MN (US)

(73) Assignee: Shuffle Master, Inc., Las Vegas, NV (US)

( * ) Notice: Subject to any disclaimer, the term of this patent is extended or adjusted under 35 U.S.C. 154(b) by 189 days.

(21) Appl. No.: 10/623,027

(22) Filed: Jul. 17, 2003

(65) Prior Publication Data

US 2005/0026682 A1 Feb. 3, 2005

(51) Int. Cl.
*A63F 1/14* (2006.01)

(52) U.S. Cl. ..... 273/149 R

(58) Field of Classification Search ..... 463/11–13, 463/22; 273/149 R, 149 P, 292
See application file for complete search history.

(56) References Cited

U.S. PATENT DOCUMENTS

| | | | | |
|---|---|---|---|---|
| 4,667,959 | A | 5/1987 | Pfeiffer et al. | |
| 4,750,743 | A | 6/1988 | Nicoletti | |
| 5,356,145 | A | 10/1994 | Verschoor | |
| 5,374,061 | A | 12/1994 | Albrecht | |
| 5,605,334 | A * | 2/1997 | McCrea, Jr. | 273/309 |
| 5,669,816 | A | 9/1997 | Garczynski et al. | |
| 5,681,039 | A | 10/1997 | Miller | |
| 5,722,893 | A | 3/1998 | Hill et al. | |
| 5,772,505 | A | 6/1998 | Garczynski et al. | |
| 5,779,546 | A * | 7/1998 | Meissner et al. | 463/25 |
| 5,919,090 | A * | 7/1999 | Mothwurf | 463/25 |
| 5,941,769 | A | 8/1999 | Order | |
| 5,989,122 | A | 11/1999 | Roblejo | |
| 6,039,650 | A | 3/2000 | Hill | |
| 6,093,103 | A | 7/2000 | McCrea, Jr. | |
| 6,117,012 | A | 9/2000 | McCrea, Jr. | |
| 6,126,166 | A | 10/2000 | Lorson et al. | |
| 6,165,069 | A | 12/2000 | Sines et al. | |
| 6,217,447 | B1 | 4/2001 | Lofink et al. | |
| 6,250,632 | B1 | 6/2001 | Albrecht | |
| 6,267,248 | B1 | 7/2001 | Johnson et al. | |
| 6,270,404 | B1 | 8/2001 | Sines et al. | |
| 6,299,536 | B1 | 10/2001 | Hill | |

(Continued)

FOREIGN PATENT DOCUMENTS

| | | |
|---|---|---|
| WO | WO 00/51076 | 8/2000 |

*Primary Examiner*—Kim Nguyen
(74) *Attorney, Agent, or Firm*—Mark A. Litman & Associates, P.A.

(57) ABSTRACT

A method and apparatus determines an identity of at least each card in a card hand at a casino table card game. The method is performed automatically by a computer-based system that reads the rank and suit of each card that leaves a dealing shoe and then uses a smart discard tray that reads the discards as they are taken from the table. It is optional and preferred to provide a signal to the computer of the presence of at least one card in the dealer's hand. Additional cards are dealt to hands. Exhausted hands are removed from the table and placed into a discard rack. Each card in each exhausted hand is read when placed in the discard rack to determine rank and suit of each placed card, and the computer reconciles cards placed in the discard rack with cards that left the dealing shoe.

37 Claims, 1 Drawing Sheet

U.S. PATENT DOCUMENTS

| | | | | |
|---|---|---|---|---|
| 6,361,044 | B1 | 3/2002 | Block et al. | |
| 6,403,908 | B1 | 6/2002 | Stardust et al. | |
| 6,460,848 | B1 | 10/2002 | Soltys et al. | |
| 6,517,435 | B1 | 2/2003 | Soltys et al. | |
| 6,517,436 | B1 | 2/2003 | Soltys et al. | |
| 6,520,857 | B1 | 2/2003 | Soltys et al. | |
| 6,527,271 | B1 | 3/2003 | Soltys et al. | |
| 6,530,836 | B1 | 3/2003 | Soltys et al. | |
| 6,530,837 | B1 | 3/2003 | Soltys et al. | |
| 6,533,276 | B1 | 3/2003 | Soltys et al. | |
| 6,533,662 | B1 | 3/2003 | Soltys et al. | |
| 6,579,180 | B1 | 6/2003 | Soltys et al. | |
| 6,579,181 | B1 | 6/2003 | Soltys et al. | |
| 6,638,161 | B1 | 10/2003 | Soltys et al. | |
| 2003/0173737 | A1* | 9/2003 | Soltys et al. | 273/149 R |

* cited by examiner

SMART TABLE CARD HAND IDENTIFICATION METHOD AND APPARATUS

BACKGROUND OF THE INVENTION

1. Field of the Invention

The present invention relates to components, systems, methods and apparatus for the identification, reading and or tracking of playing card hands in a gaming environment, such as in casino table card games.

2. Background of the Art

Casinos and other forms of gaming constitute a very large industry. Large amounts of money are exchanged and placed at risk and it has always been a significant concern of the industry in protecting the casinos and players against fraudulent events. In casino table card games, there are generally three areas of risk in fraud, 1) falsifying/replacing playing cards, 2) falsifying/replacing chips, and 3) passing of information improperly. Casinos would also classify certain forms of play at card games as at least undesirable, if not excludable (such as card-counting).

Numerous different methods have been proposed and instituted to defend against these types of fraud. There is extensive physical surveillance of casinos, both directly by personnel and less intrusively by overhead cameras that view and record wagering and play activities. Trained personnel watch the play of games and individual players, identifying situations and events that indicate problems. Although most of these trained individuals can detect chip substitution, card exchanges and some forms of unauthorized player/dealer communications, it is difficult for the observers' attention to be maintained at the highest levels consistently.

There are other reasons for observing the play of casino table card games, such as to rate the efficiency of dealers over time, rate the efficiency of players over time, and provide a statistical basis for analysis of new games. This can assist the casino in rating players for comps and special invitations and identify preferred dealers for higher stake tables.

While some aspects of a casino's security system should be plainly visible as a deterrent, other aspects of the security should be unobtrusive to avoid detracting from the players' enjoyment of the game and to prevent cheaters and thieves from avoiding detection. Some of the current methods of tracking have drawbacks. The methods typically depend on manual observation of a gaming table. Thus coverage is not comprehensive, and is limited to tracking a relatively small number of games, customers and employees. This problem is exacerbated by a customer's ability to rapidly move between gaming tables. A commonly known method for cheating customers to avoid detection is to switch tables frequently. The tracking methods are also prone to error since the manual methods rely on human observers who can become inattentive or distracted. In one commonly known method of cheating the casino, one member of a team will create a distraction while another member steals chips or swaps cards. These manual tracking methods are also labor intensive, and thus costly.

The advance of technology in the fields of imaging, symbol recognition, computers and software has enabled the potential for greater utilization of technology to automatically provide a basis for security as opposed to merely providing a source of information for humans to evaluate. Security enhancing systems are needed in various different aspects of the play of casino table card games, and many different systems have been proposed.

U.S. Pat. No. 6,126,166 (Lorson) describes an integrated blackjack game control system having multiple sensors and output devices, electronic signal processing equipment, passive and active operator control devices, and a computer system. The system components are capable of being installed on or near existing blackjack tables and support equipment, and to operate with standard playing cards. The system performs several simultaneous functions to accelerate the play of a game of blackjack, enhance the shuffling process, and perform continuous monitoring of key dealer and table performance attributes. The system gathers information on the distribution of cards in the discard shoe from knowledge of the sequence of cards dealt during game play. When signaled, the system determines appropriate sequence, number, and positions of the pre-shuffle plug locations of the cards in the discard shoe. The system transmits the pre-shuffle card plug information to an output device driver assembly that actuates the desired output devices. In one implementation, the system output devices are light-emitting diodes, but any number of electric, acoustic, or mechanical devices could be utilized.

U.S. Pat. No. 6,299,536 describes a playing card dispensing shoe apparatus, system and method, wherein the shoe has a card scanner which scans the indicia on a playing card as the card moves along and out of a chute of the shoe by operation of the dealer. The scanner is located on the outlet slope of the dispenser, not within any card moving element internal to the device. The scanner comprises an optical-sensor used in combination with a neural network which is trained using error back-propagation to recognize the card suits and card values of the playing cards as they are moved past the scanner, so specially coded information is not needed. The scanning process in combination with a central processing unit (CPU) determines the progress of the play of the game and, by identifying card counting systems or basic playing strategies in use by the players of the game, provides means to limit or prevent casino losses and calculate the Theoretical Win of the casino, thus also providing an accurate quality method of the amount of comps to be given a particular player. The shoe is also provided with additional devices that make it simple and easy to access, record and display other data relevant to the play of the game. These include means for accommodating a "customer-tracking card" which reads each player's account information from a magnetic stripe on the card, thus providing access to the player's customer data file stored on the casino's computer system, and one or more alpha-numeric keyboards and LCD displays used to enter and retrieve player and game information. Also included are keyboards on the game table so that each player can individually select various playing or wagering options using their own keyboard. The system is more focused on analysis of overall play at a table and by individuals rather then identifying specific hands and play at each round of a card game. The system evaluates individual player strategy and proficiency after the read card information is sent to a computer There are numerous U.S. Patents that have been issued to MindPlay LLP relating to table security systems. These patents teach card dealing shoes, card discard racks, and a camera reading system that can read suit and rank. These U.S. Patents include U.S. Pat. Nos. 6,579,181; 6,579,1810; 6,533,662; 6,533,276; 6,530,837; 6,530,836; 6,527,271; 6,520,857; 6,517,436; 6,517,435; and 6,460,848, all titled Method and Apparatus for Monitoring Casinos and Games.

U.S. Pat. No. 6,460,848 relates to the card reading tray itself. There is no clear disclosure of two distinct card-reading systems. However, the MindPlay system does clearly read cards in a shoe before dealing the cards. There is also reference to knowledge of the order of cards in a discard holder. The overall objective of the invention appears to be the provision of a system that automatically monitors playing and wagering of a game, including the gaming habits of players and the performance of employees. A card deck reader automatically reads a symbol from each card in a deck of cards before a first one of the cards is removed. The symbol identifies a respective rank and suit of the card. A chip tray reader automatically images the contents of a chip tray, to periodically determine the number and value of chips in the chip tray, and to compare the change in contents of the chip tray to the outcome of game play for verifying that the proper amounts have been paid out and collected. A table monitor automatically images the activity occurring at a gaming table. Periodic comparison of the images identifies wagering, as well as the appearance, removal and position of cards and other game objects on the gaming table. A drop box automatically verifies an amount and authenticity of a deposit and reconciles the deposit with a change in the contents of the chip tray. The drop box employs a variety of lighting and resolutions to image selected portions of the deposited item. The system detects prohibited playing and wagering patterns, and determines the win/loss percentage of the players and the dealer, as well as a number of other statistically relevant measures. The measurements provide automated security and real-time accounting and complimentary player benefits.

U.S. Pat. Nos. 5,605,334 and 6,093,103 and disclose a card-reading element or section or attachment to a card shuffler. The disclosure is read in combination with U.S. Pat. No. 5,356,145 (Verschoor, which discloses the 'shuffler'). The secure game table system is for monitoring each hand in a progressive live card game, said progressive live card game having at least one deck, said at least one deck having a predetermined number of cards, said secure game table system having players at a plurality of player positions and a dealer at a dealer position. The secure game table system comprises: a shoe for holding each card from at least one deck before being dealt by said dealer in said hand, said shoe having a detector for reading at least the value and the suit of said each card, said detector issuing a signal corresponding at least to said value and suit for said each card, a progressive bet sensor located near each of said plurality of player positions for sensing the presence of a progressive bet, when said progressive bet is sensed, said progressive bet sensor issuing a signal corresponding to said presence, a card sensor located near each of said plurality of player positions and said dealer position, said card sensor issuing a signal when a card in said hand is received at said card sensor, and a game control. The game control has a memory and is receptive of progressive bet signals from the progressive bet sensor at each of player position for storing in memory which player positions placed a progressive bet. The game control is receptive of value and suit signals from the detector in the shoe for storing in memory at least the value and suit of each card dealt from the shoe into each hand. The game control is receptive of card received signals from card sensors at each of player position and the dealer position. The game control correlates in memory each card dealt from the shoe in game sequence to each card received at a player position having a progressive bet sensed.

U.S. Pat. No.5,772,505 (Garczynski) describes a dual card scanning module that announces when the symbols of a face-up standard playing card and a face-down standard playing card achieve a desired combination. The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the face-down standard playing card. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination.

U.S. Pat. No. 5,941,769 (Order) describes a system for professional use in table games of chance with playing cards and gaming chips (jettons), in particular the game of Blackjack. The system provides an automatically working apparatus that will register and evaluate all phases of the run of the game automatically. This is achieved by a card shoe with an integrated device for recognition of the value of the drawn cards (3') (optical recognition device and mirroring into a CCD-image converter); photodiodes (52) arranged under the table cloth (51) in order to register separately the casino light passing through each area (53, 54) for placing the gaming chips (41) and areas (55, 56) for placing the playing cards (3) in dependence of the arrangement or movement of the jettons and playing cards on the mentioned areas; a device for automatic recognition of each bet (scanner to register the color of the jettons, or a RFID-system comprising a S/R station and jettons with integrated transponder); an EDP program created in accordance with the gaming rules to evaluate and store all data transmitted from the functional devices to the computer; and a monitor to display the run of the game and players' wins.

U.S. Pat. No. 5,374,061 (Albrecht) describes a system that uses a specially coded deck of cards indicating the value and suit of the card or a value related to the count of the card as well as whether the card belongs to a particular set of cards senses the code on the card and sends the detected signal to a processor. The processor determines a running count, a betting count, a true count or other information related to the profitability of a particular wager or particular action, such as an insurance bet as well as an indication of whether the card belongs to the particular set of cards assigned to the table. The counts are displayed centrally and/or remotely from the shoe that dispenses the cards. The electronics for the system may be internally included as part of the shoe or externally included as a separate unit in which the shoe is secured.

SUMMARY OF THE INVENTION

A method and apparatus determines an identity of at least each card in a card hand at a casino table card game. The method is performed automatically by a computer-based system that reads the rank and suit of each card that leaves a dealing shoe and then uses a smart discard tray that reads the discards as they are taken from the table. Play is practiced by dealing a hand to a player and dealing either a hand to a dealer or common cards to the table. It is optional and preferred to provide a signal to the computer of the presence of at least one card in the dealer's hand. Additional cards are dealt to hands (if required according to rules of the casino table card game. Exhausted hands are removed from the table and placed into a discard rack. Each card in each exhausted hand is read when placed in the discard rack to determine rank and suit of each placed card, and the computer reconciles cards placed in the discard rack with cards that left the dealing shoe.

DETAILED DESCRIPTION OF THE INVENTION

Figure 1:
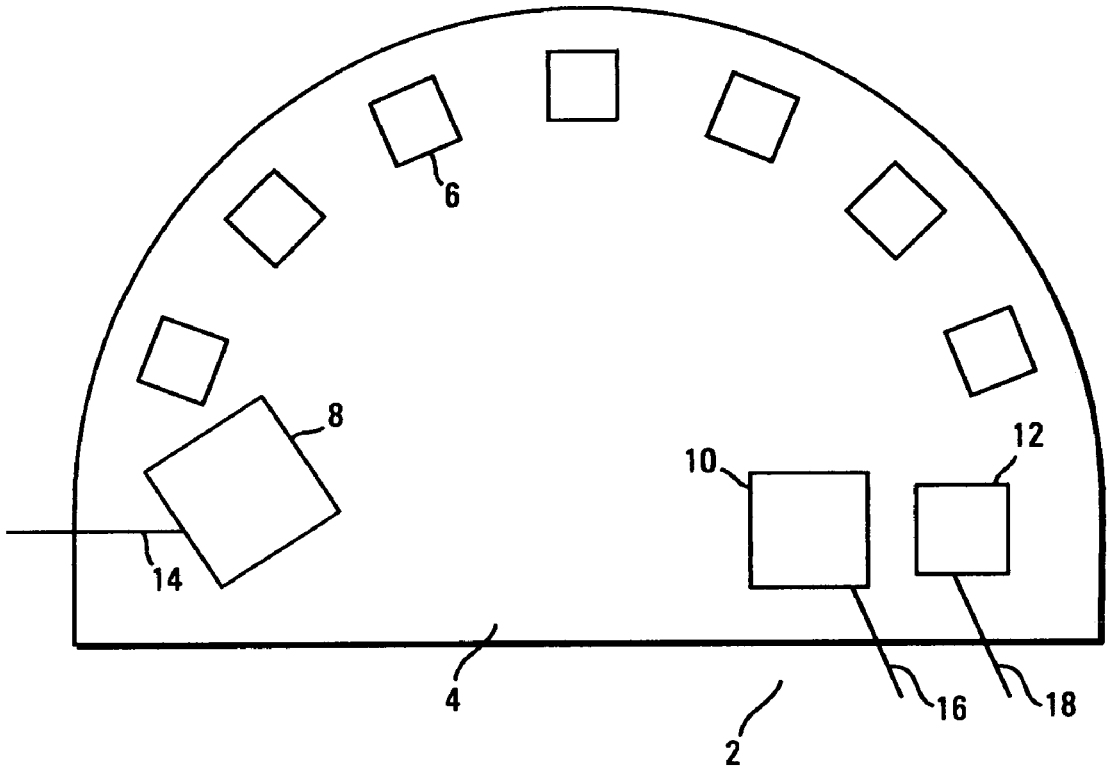
FIG. 1 shows a block diagram of the minimum components for the hand-reading system of the invention, a smart card-reading delivery shoe and a smart card-reading discard rack.

Card hands and card play are read by a system that comprises a card-reading delivery shoe and a card-reading discard tray. The term "smart" is used with respect to components in the system because of their use or connection to memory and processing and/or storage intelligence (e.g., microprocessors, processors, and computers) and the use of that processing and/or storage intelligence in the practice of processes according to the teachings of the invention.

A smart card delivery shoe is used that reads the suit and rank of each card before it is delivered to the various positions where cards are to be dealt in the play of the casino table card game. The cards are then dealt according to the rules of the game to the required card positions. Different games have diverse card distribution positions, different card numbers, and different delivery sequences that the hand identifying system of the invention must encompass. For example, in the most complex of card distribution games of blackjack, cards are usually dealt one at a time in sequence around a table, on card at-a-time to each player position and then to the dealer position. The one card at a time delivery sequence is again repeated so that each player position and the dealer position have an initial hand of exactly two cards. Complexity in hand development is introduced because players have essentially unlimited control over additional cards until point value in a hand exceeds a count of twenty-one. Players may stand with a count of 2 (two aces) or take a hit with a count of 21 if they are so inclined, so the knowledge of the count of a hand is no assurance of what a player will do. The dealer, on the other hand, is required to follow strict house rules on the play of the game according to the value of the dealer's hand. Small variances such as allowing or disallowing a hit on a "soft" seventeen count (e.g., an Ace and a 6) may exist, but the rules are otherwise very precise so that the house or dealer cannot exercise any strategy. This is a complex system in which to attempt to provide an automated system that identifies each individual hand at a table without having to provide card-reading sensors at every player position or an overhead camera to read every card at the table. Even those expensive systems are susceptible to manipulation or fraud and do not provide maximum security.

Other cards games may provide equal numbers of cards in batches. Variants of stud poker played against a dealer, for example, would usually provide hands of five cards, five-at-a-time to each player position and if competing against a dealer, to the dealer position. This card hand distribution is quite simple to track as each sequence of five cards removed from the dealer shoe is a hand.

Other games may require cards to be dealt to players and other cards dealt to a flop or common card area. The system should also be programmable to cover this alternative if it is so desired.

Baccarat is closer to blackjack in card sequence of dealing, but has more rigid rules as to when hits may be taken by the player and the dealer, and each position may take a maximum of one card as a hit. The hand identification system of the invention must be able to address the needs of identifying hands in each of these types of games and especially must be able to identify hands in the most complex situation, the play of blackjack.

The general operation of the system of the invention will be described and the examples of specific implementations (e.g., smart delivery shoes, smart discard tray, software, computers, components and subcomponents) are intended to be merely exemplary and are not to be read as limiting in the scope of practice of the invention. For example, where cameras are used to read cards, the light sensitive system may be any image capture system, digital or analog, that is capable of identifying the suit and rank of a card.

A first step in the operation is to provide a set of cards to the smart delivery shoe, the cards being those cards that are going to be used in the play of a casino table card game. The set of cards (usually one or more decks) is provided in an already randomized set, being taken out of a shuffler or having been shuffled by hand. A preferred smart delivery shoe is described in copending U.S. patent application Ser. No. 10/622,321, filed the same date as this application, titled SMART DELIVERY SHOE, which application is incorporated herein in its entirety by reference for its entire disclosure of the card reading a delivery capability and structure of that device and all enabling disclosure therein. Alternative, but less preferred card delivery systems or shoes with reading capability include, but are not limited to those disclosed in U.S. Pat. Nos. 4,750,743; 5,779,546; 5,605,334; 6,361,044; 6,217,447; 5,941,769; 6,229,536; 6,460,848; 5,722,893; 6,039,650; and 6,126,166. Some of these system require specially coded cards, which is particularly undesirable, but may be used as an alternative. The cards are read in the smart card delivery shoe, preferably one card at a time in sequence. Reading cards by edge markings and special codes (as in U.S. Pat. No. 6,460,848) requires special encoding and marking of the cards. The entire sequence of cards in the set of cards is thus determined and stored in memory. Memory may be at least in part in the smart delivery shoe, but communication with a central processor is highly desirable and preferred. The sequence would then also or solely be stored in the central computer.

The cards are then dealt out of the smart delivery shoe, the delivery shoe registering how many cards are removed one-at-a-time. This is easily accomplished by the above identified U.S. patent application Ser. No. 10/622321 where cards are fed to the dealer removal area one at a time, so only one card can be removed by the dealer. As each card is removed, a signal is created indicating that a specific card (of rank and suit) has been dealt. The computer and system knows only that a first card has been dealt, and it is presumed to go to the first player. The remaining cards are dealt out to players and dealer. In the play of certain games (e.g., stud variants) where specific numbers of cards are known to be dealt to each position, the shoe may be programmed with the number of players at any time, so hands can be correlated even before they have been dealt. If the shoe is playing a stud variant where each player and the dealer gets three cards (Three Card Poker™ game), the system will know in advance of the deal what each player and the dealer will have as a hand. It is also possible that there be a signal available (particularly desirable in blackjack) when the dealer has received either his first card (e.g., when cards are dealt in sequence, one-at-a-time) or has received his entire hand. The signal is desirable as that signal can be readily used to automatically determine the number of player positions active on the table at any given time. For example, if in a hand of blackjack the dealer receives the sixth card, the system will immediately know that there are five players at the table. The signal can be given manually (pressing a button at the dealer position or on the smart card delivery shoe) or can be provided automatically (a card presence sensor at the dealer's position, where a card can be placed over the sensor to provide a signal). Where an automatic signal is provided by a sensor, some physical protection of the sensor is preferably provided, such as a shield that would prevent accidental contact with the sensor or blockage of the sensor. An L-shaped cover would be very desirable so a card could be slid under the arm of the L parallel to the table surface and cover the sensor under that branch of the L. The signal can also be given after all cards for the hand have been delivered, again indicating the number of players, For example, when the dealer's two cards are slid under the L-shaped cover to block or contact the sensor, the system will know the total number of cards dealt on the hand (e.g., 10 cards), know that the dealer has 2 cards, determine that players therefore have 8 cards, and know that each player has 2 cards each, thereby absolutely determining that there are four active player positions at the table (10−2=8 and then 8/2=4 players). This automatic determination is highly desirable as opposed to having dealers input the number of players each hand at a table or having to manually change the indicated number of players at a table each time the number changes.

Once all active positions have been dealt to, the system knows what cards are initially present in each player's hand, the dealer's hand, and any flop or common hand. The system operation is now simple when no more cards are provided to play the casino table game. All hands are then known and all outcomes can be predicted. The complication of additional cards will be addressed with respect to the game of blackjack.

After dealing the initial set of two cards per hand, the system cannot immediately know where each remaining card will be dealt. The system does know what cards are dealt, however. It is with this knowledge and a subsequent identification of discarded hands that the hands and cards from the smart delivery shoe can be reconciled or verified. Each hand is already identified by the presence of two specifically known cards. Hands are then played according to the rules of the game, and hands are discarded when play of a hand is exhausted. A hand is exhausted when 1) there is a blackjack, the hand is paid, and the cards are cleared; 2) a hand breaks with a count over twenty-one and the cards are cleared; and/or a round the game is played to a conclusion, the dealer's hand completed, all wagers are settled, and the cards are cleared. As is typically done in a casino to enable reconciling of hands manually, cards are picked up in a precise order from the table. The cards are usually cleared from the dealer's right to the dealer's left, and the cards at each position comprise the cards in the order that they were delivered, first card on the bottom, second card over the first card, third card over the second card, etc. maintaining the order or a close approximation of the order (e.g., the first two cards may be reversed) is important as the first two cards form an anchor, focus, basis, fence, end point or set edge for each hand. For example, if the third player position was known to have received the 10 of hearts (10H) and the 9 of spades (9S) for the first two card, and the fourth player was known to receive the 8 of diamonds (8D) and the 3 of clubs (3C) for the first two cards, the edges or anchors of the two hands are 9S/10H and 8D/3C. When the hands are swept at the conclusion of the game, the cards are sent to a smart discard rack (e.g., see U.S. patent application Ser. No. 10/622,388, filed the same date as this application, and titled Smart Discard Rack, which application is incorporated herein by reference in its entirety for its disclosure and enablement) and the hand with the 9S/10H was not already exhausted (e.g., broken or busted) and the swept cards consist of 9S, 10H, 8S, 8D and 3C (as read by the smart discard rack), the software of the processor will automatically know that the final hands in the third and fourth positions were a count of 19 (9S and 10H) for the third hand and 19 (8D and 3C originally plus the 8S hit) for the fourth hand. The analysis by the software specifically identifies the fourth hand as a count of 19 with the specific cards read by the smart discard shoe. The information from reading that now exhausted hand is compared with the original information collected from the smart delivery shoe. The smart delivery shoe information when combined with the smart discard rack information shall confirm the hands in each position, even though cards were not uniformly distributed (e.g., player one takes two hits for a total of four cards, player two takes three hits for a total of five cards, player three takes no hit for a total of two cards, player four takes one hit for a total of three cards, and the dealer takes two hits for a total of four cards).

The dealer's cards may be equally susceptible to analysis in a number of different formats. After the last card has been dealt to the last player, a signal may be easily and imperceptibly generated that the dealer's hand will now become active with possible hits. For example, with the sensor described above for sensing the presence of the first dealer card or the completion of the dealer's hand, the cards would be removed from beneath the L-shaped protective bridge. This type of movement is ordinarily done in blackjack where the dealer has at most a single card exposed and one card buried face down. In this case, the removal of the cards from over the sensor underneath the L-cover to display the hole card is a natural movement and then exposes the sensor. This can provide a signal to the central processor that the dealer's hand will be receiving all additional cards in that round of the game. The system at this point knows the two initial cards in the dealer's hand, knows the values of the next sequence of cards, and knows the rules by which a dealer must play. The system knows what cards the dealer will receive and what the final total of the dealer's hand will be because the dealer has no freedom of decision or movement in the play of the dealer's hand. When the dealer's hand is placed into the smart discard rack, the discard rack already knows the specifics of the dealer's hand even without having to use the first two cards as an anchor or basis for the dealer's hand. The cards may be treated in this manner optionally, but it is not essential.

When the hands are swept from the table, dealer's hand then players' hands from right to left (from the dealer's position or vice-versa if that is the manner of house play), the smart discard rack reads the shoes, identifies the anchors for each hand, knows that no hands swept at the conclusion can exceed a count of twenty-one, and the computer identifies the individual hands and reconciles them with the original data from the smart delivery shoe. The system thereby can identify each hand played and provide system assurance that the hand was played fairly and accurately.

If a lack of reconciling by the system occurs, a number of events can occur. A signal can be given directly to the dealer position, to the pit area, or to a security zone and the cards examined to determine the nature and cause of the error and inspect individual cards if necessary. When the hand and card data is being used for various statistical purposes, such as evaluating dealer efficiency, dealer win/loss events, player efficiency, player win/loss events, statistical habits of players, unusual play tactics or meaningful play tactics (e.g., indicative of card counting), and the like, the system may file the particular hand in a 'dump' file so that hand is not used in the statistical analysis, this is to assure that maximum benefits of the analysis are not tilted by erroneous or anomalous data.

There are a number of features and benefits in the practice of this technology. The sensing or signaling of the presence of the dealer's hand as an integral step in the hand identification sequence provides a clear line of demarcation between stages of play in blackjack or other games. This step simplifies software procedures. By processing signals from both the dealing shoe and the discard rack to verify hands and play, the system is enabled for use with any type of shuffling or randomization system for cards, including manual shuffling. In this regard, it is possible to combine a shuffler (with internal card recognition capability and a signaling system to indicate when cards are being removed one-at-a-time) and a smart discard rack to perform the process of the invention.

The system can also provide date stamping of each card dealt (actual time and date defining sequence, with concept of specific identification of sequence identifier possibly being unique). The date stamping may also be replaced by specific sequence stamping or marking, such as a specific hand number, at a specific table, at a specific casino, with a specific number of players, etc. The records could indicate variations of indicators in the stored memory of the central computer of Lucky 777 Casino, Aug. 19, 1995, 8:12:17 a.m., Table 3, position 3, hand 7S/4D/9S, or simply identify something similar by alphanumeric ode as L7C-819-95-3-3-073-7S/4D/9S (073 being the 73$^{rd}$ hand dealt). This date stamping of hands or even cards in memory can be used as an analytical search tool for security and to enhance hand identification.

FIG. 1 shows a block diagram of the minimum components for the hand-reading system on a table 4 of the invention, a smart card-reading delivery shoe 8 with output 14 and a smart card-reading discard rack 12 with output 18. Player positions 6 are shown, as is a dealer's hand position sensor 10 without output port 16.

The use of the discard rack acting to reconcile hands returned to the discard rack out-of-order (e.g., blackjack or bust) automatically is a clear advantage. The software as described above can be easily programmed to recognize hands removed out-of-dealing order on the basis of knowledge of the anchor cards (the first two cards) known to have been dealt to a specific hand. For example, the software will identify that when a blackjack was dealt to position three, that hand will be removed, the feed of the third hand into the smart card discard tray confirms this, and position three will essentially be ignored in future hand resolution. More importantly, when the anchor cards were, for example, 9S/5C in the second player position and an exhausted hand of 8D/9S/5C is placed into the smart discard rack, that hand will be identified as the hand from the second player position. If two identical hands happen to be dealt in the same round of play, the software will merely be alerted (it knows all of the hands) to specifically check the final order of cards placed into the smart discard rack to more carefully position the location of that exhausted hand. This is merely recognition software implementation once the concept is understood.

The step of removal of cards from dealer's sensor or other initiated signal identifies that all further cards are going to the dealer has already been identified as of particular benefit in defining edges of play between rounds and firmly identifying the dealer's hand and the end of a round of play. When the dealer's cards are deposited and read in the smart discard rack, the central computer knows that another round of play is to occur and a mark or note is established that the following sequence will be a new round and the analytical cycle begins all over again.

The discard rack indicates that a complete hand has been delivered by absence of additional cards in the Discard Rack in-feed tray. When cards are swept from an early exhausted hand (blackjack or a break), they are swept one at a time and inserted into the smart discard rack one at a time. When the smart discard rack in-feed tray is empty, the system understands that a complete hand has been identified, and the system can reconcile that specific hand with the information from the smart delivery shoe. The system can be hooked-up to feed strategy analysis software programs such as the SMI licensed proprietary Bloodhound™ analysis program.

What is claimed:

1. A method of determining an identity of at least each card in card hands at a casino table card game comprising:

automatically reading the rank and suit of each card that leaves a dealing shoe;

dealing hands according to rules of play of the casino table card game with at least one hand comprising at least one card being dealt to a player;

defining an edge of the at least one hand by the read rank and suit of the at least one card dealt to the player;

dealing additional cards to the hands according to the rules of the casino table card game;

providing a signal of at least one of a completion of a hand, a completion of initial hands or completion of first cards having been dealt to all players present at the table by manual activation of a signal by a dealer or automatic signaling resulting from sensing of a card at a signal position;

removing exhausted hands from the table and placing the exhausted hands in a discard rack;

reading each card placed in the discard rack from the exhausted hands to determine rank and suit of each card placed in the discard rack; and reconciling the cards placed in the discard rack with the cards that left the dealing shoe.

2. The method of claim 1 wherein in addition to the at least one hand being dealt to the player, a hand is dealt to the dealer or to a common card area, and automatic signaling results from sensing of a card at a signal position comprising the common card area or a position where dealer's cards are placed.

3. The method of claim 2 wherein the first card, an initial hand or the complete hand is dealt to the dealer and the signal of the completion of hands comprises signaling that a first card, the initial hand or complete hand has been provided to the dealer.

4. The method of claim 2 wherein there are multiple players and each of the mutliple players receives an at least one card, and the signal is provided when a) a first dealer card, the initial hand or dealer's complete hand is received or b) at least a common card is received in the common card area.

5. The method of claim 4 wherein the signal is provided that the first dealer's card or the dealer's initial hand has been provided to the dealer.

6. The method of claim 5 wherein a number of active player positions is determined by a count of a number of cards that leave the dealing shoe before the first dealer card or first common card is signaled.

7. The method of claim 5 wherein complete hands of a specific number of cards are sequentially dealt to players and a number of active player positions is determined by a count of the number of cards dealt divided by the number of cards before the signal of the presence of at least one card in the dealers hand or the common card(s) is made.

8. The method of claim 5 wherein the casino table card game is blackjack and cards are dealt to each player position and a dealer position one at a time.

9. The method of claim 8 wherein exhausted hands placed in the discard rack are reconciled with known hands, the known hands based at least on knowledge of a set of first two cards wherein each card of the at least two cards has left a dealing shoe and was automatically read for its rank and suit and then was received in a hand that became an exhausted hand and the exhausted hand was placed in the discard rack.

10. The method of claim 4 wherein a number of active player positions is determined by a count of a number of cards that leave the dealing shoe before the first dealer card or first common card is signaled, and edges of each player hand are defined by the read rank and suit of the at least one card received by the player.

11. The method of claim 4 wherein complete hands of a specific number of cards are sequentially dealt to players and a determined number of active player positions is determined by a count of an initial number of cards dealt divided by the initial number of cards per hand before the signal of the presence of at least one card in the dealers hand or common cards is made.

12. The method of claim 11 wherein the casino table card game is blackjack and cards are dealt to each player position and a dealer position one at a time.

13. The method of claim 4 wherein the casino table card game is blackjack and cards are dealt to each player position and a dealer position one at a time.

14. The method of claim 13 wherein a signal of the presence of a dealer's initial hand is used to determine a number of active player positions.

15. The method of claim 13 wherein exhausted hands placed in the discard rack are reconciled with hands that have automatically had their rank and suit read as each card left the dealing shoe; and then were dealt as hands according to the rules of play and based at least on knowledge of a set of first two cards received in a hand placed in the discard rack.

16. The method of claim 4 wherein a signal of the presence of a dealer's initial hand is used to determine a number of active player positions.

17. The method of claim 4 wherein a first number of complete hands of a specific number of cards are sequentially dealt to players and a determined number of active player positions is determined by a count of a second number of cards dealt divided by an actual number of cards dealt before the signal of the presence of at least one card in the dealers hand or the common cards is made.

18. The method of claim 1 wherein a number of active player positions is determined by a count of a number of cards that leave the dealing shoe before a first dealer card, dealer initial hand, a first common card or complete set of common cards is signaled.

19. The method of claim 18 wherein all active player positions are determined and after determination of all active player positions, initial hands for each player position are determined as known hands.

20. The method of claim 18 wherein the casino table card game is blackjack and cards are dealt to each player position and a dealer position one at a time.

21. The method of claim 20 wherein a signal of the presence of a dealer's initial hand is used to determine a number of active player positions.

22. The method of claim 20 wherein all active player positions are determined and after determination of all active player positions, initial hands for each player position are determined as known hands.

23. The method of claim 20 wherein exhausted hands placed in the discard rack are reconciled with hands that have automatically had their rank and suit read as each card left the dealing shoe; and then were dealt as hands according to the rules of play and based at least on knowledge of a set of first two cards received in a hand placed in the discard rack.

24. The method of claim 20 wherein exhausted hands placed in the discard rack are reconciled with hands that have automatically had their rank and suit read as each card left the dealing shoe; and then were dealt as hands according to the rules of play and based at least on knowledge of a set of first two cards received in a hand placed in the discard rack.

25. The method of claim 1 wherein exhausted hands placed in the discard rack are reconciled with hands that have automatically had their rank and suit read as each card left the dealing shoe; and then were dealt as hands according to the rules of play and based at least on knowledge of a set of first two cards received in a hand placed in the discard rack.

26. The method of claim 1 wherein exhausted hands placed in the discard rack are reconciled with hands that have automatically had their rank and suit read as each card left the dealing shoe; and then were dealt as hands according to the rules of play and based at least on knowledge of a set of first two cards received in a hand placed in the discard rack.

27. A system for determination of at least individual hands of cards in a casino table card game comprising:

a card delivery device that reads the rank and suit of first cards delivered to a player hand position and/or a dealer hand position, and sends first signals of the suit and rank of each card to a processor, the processor identifying the rank and suit of the first cards delivered to a player hand position as an edge of a hand;

the card delivery device in combination with a card sensor automatically providing a signal to the processor that dealing of a partial hand has been completed;

a card discard tray that reads the rank and suit of each card delivered to the card discard tray, and sends second signals of the suit and rank of each card in the card discard tray to the processor, and the processor receiving the signals from the delivery device and the discard tray and identifying the at least individual hands that were played in the casino table card game based on comparison of the first and second signals.

28. The system of claim 27 communicatively associated with a blackjack card table.

29. The system of claim 28 wherein a signaling element is communicatively associated with the system to automatically indicate at least one of when a dealer has received a first card or a dealer has received two cards, or a dealer has received all cards in a dealer hand.

30. The system of claim 29 wherein the signaling element comprises a sensor sensing a dealer's card or dealer's cards.

31. The system of claim 29 wherein hands of each player position are identified by an anchor reference comprising the identity of two cards first received at the player position.

32. The system of claim 28 wherein hands of each player position are identified by an anchor reference comprising the identity of two cards first received at the player position.

33. The system of claim 27 wherein a signaling element is communicatively associated with the system to indicate at least one of when a dealer has received a first card or a dealer has received two cards and wherein the signaling element comprises a manually activated element.

34. The system of claim 27 wherein hands delivered to every player position are identified by an anchor reference comprising identity of two cards first received at each player position.

35. The system of claim 27 wherein completion of dealing cards to players and a possibility of providing additional cards to a dealer is identified by a dealer's signal.

36. The system of claim 35 wherein the dealer's signal is provided by clearing a view from a sensor.

37. The system of claim 35 wherein the dealer's signal is provided by manual activation of a dealer's signaling element.

* * * * *